United States Patent [19]

Toth

[11] Patent Number: 4,788,961

[45] Date of Patent: Dec. 6, 1988

[54] UNIVERSAL BRACKET FOR ARCHERY BOW ACCESSORIES

[76] Inventor: Dennis M. Toth, 1362 Liberty, Lincoln Park, Mich. 48146

[21] Appl. No.: 929,251

[22] Filed: Nov. 10, 1986

Related U.S. Application Data

[63] Continuation-in-part of Ser. No. 613,976, May 25, 1984, Pat. No. 4,621,606.

[51] Int. Cl.[4] ..... F41B 5/00

[52] U.S. Cl. ..... 124/24 A; 124/87; 124/88; 33/265

[58] Field of Search ..... 124/23 A, 24 A, 86, 124/87, 88, 45, 41 A, 23 R, 24 R

[56] References Cited

U.S. PATENT DOCUMENTS

| | | | |
|---|---|---|---|
| 3,522,916 | 8/1970 | Saunders | 124/23 R |
| 3,840,944 | 10/1974 | Gresley | 124/23 A |
| 3,949,730 | 4/1976 | Schoenberger | 124/24 R |
| 4,156,496 | 5/1979 | Stinson | 124/23 A |
| 4,596,229 | 6/1986 | Bell | 124/24 R |
| 4,621,606 | 11/1986 | Toth | 124/24 A |
| 4,635,611 | 1/1987 | Priebe | 124/24 A |

*Primary Examiner*—Richard C. Pinkham

*Assistant Examiner*—Gary Jackson

*Attorney, Agent, or Firm*—Brooks & Kushman

[57] ABSTRACT

An archery bow having accessories attached to the bow by a support block having an internal opening which receives a tang extending from an archery accessory. Accessories which may be attached to the bow include a detachable sight, an auxiliary arrow holder and a bow-fishing reel. More than one accessory may be locked to the support block. A shoulder is formed where the tang extends from the accessory to aid in positioning the accessory in the support block. The auxiliary arrow holder is an arm having a arrow support bracket on the end opposite the tang which includes a plurality of resilient fingers aligned on opposite sides and axially offset from each other for gripping the shaft of an arrow. The bow-fishing accessory includes a reel having a thin rim with a concave perimeter and a brace offset from the central axis of the rim. The reel is connected to the support block by an arm extending between the brace and the tang. A detachable quiver may be attached to the support block with the support block including one part of the detachable quiver mount and the quiver including a second part of the detachable quiver mount.

19 Claims, 3 Drawing Sheets

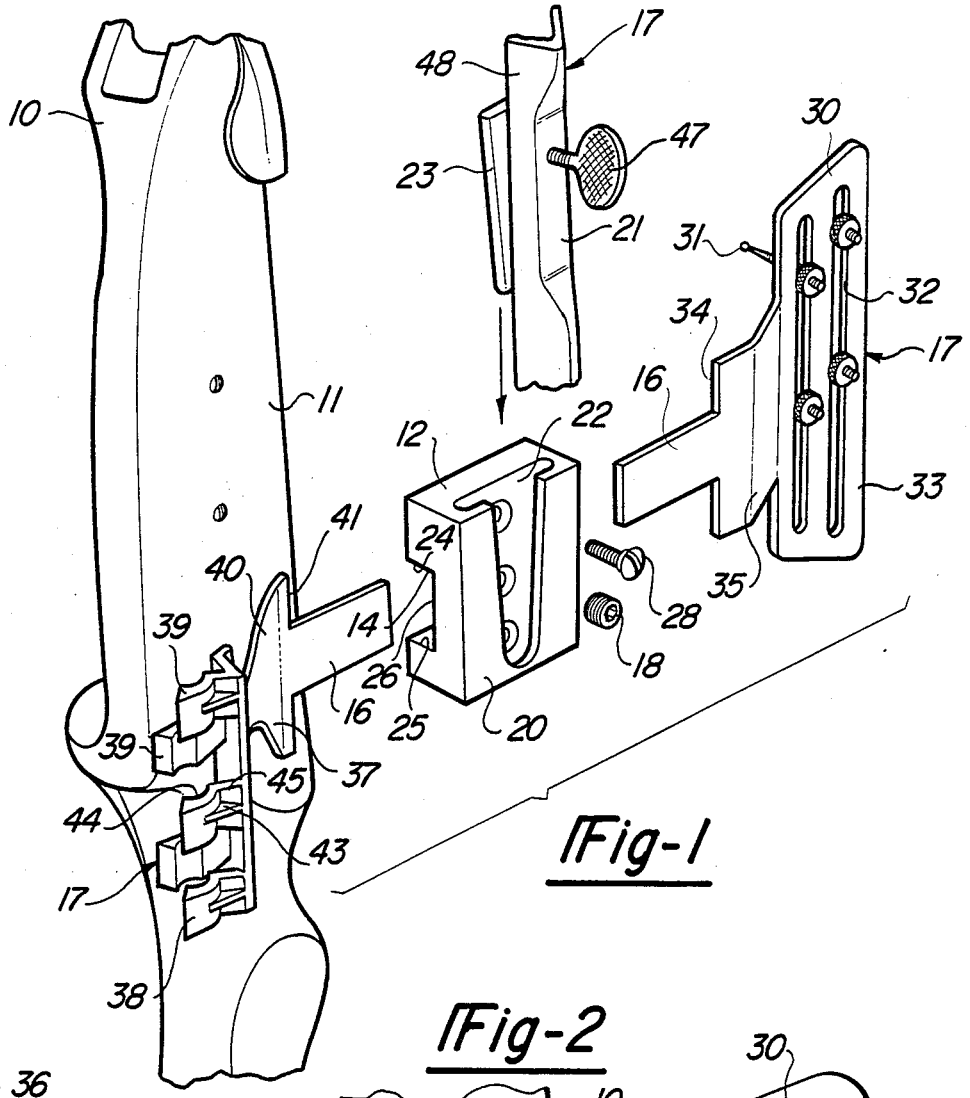
Fig-1
Fig-2
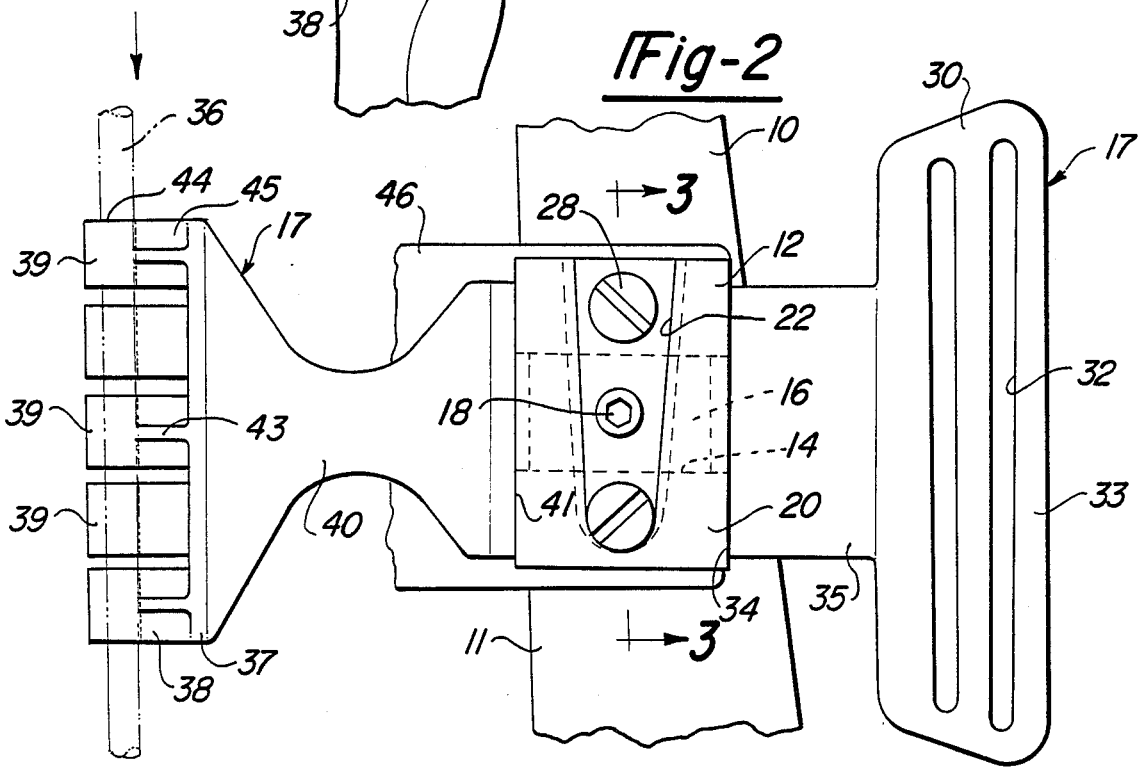

UNIVERSAL BRACKET FOR ARCHERY BOW ACCESSORIES

CROSS REFERENCE TO RELATED APPLICATION

This application is a continuation-in-part of my prior application Ser. No. 613,976 filed May 25, 1984, U.S. Pat. No. 4,621,606.

INTRODUCTION

1. Technical Field

The present invention relates to an improved accessory bracket for archery bows and more particularly to a support block on which one or more accessories may be interchangeably attached to an archery bow.

2. Background Art

Archery accessories such as quivers, sights, bow-fishing reels and the like are known to be attached to archery bows. Detachable or semipermanent quivers are frequently secured to an archery bow. Also, adjustable sights are generally attached to a bow. Another accessory which an archer may wish to attach to a bow is a bow-fishing reel. As disclosed in my copending application, Ser. No. 613,976 filed May 25, 1984 disclosure of which is hereby incorporated by reference, an arm and bracket for retaining auxiliary arrow independent of the quiver may be attached to an archery bow.

Currently available archery accessories are normally mounted directly to the central portion of the bow by separate mounts or by stacked mounting plates. The long felt need satisfied by the present invention is the provision of a convenient mounting bracket especially adapted to mount more than one accessory to an archery bow which is stable and simple to assemble.

An example of a quiver which is permanently secured to the handle portion of a bow is disclosed in U.S. Pat. No. 3,777,734 to Rose. A detachable quiver is disclosed in U.S. Pat. No. 4,156,496 to Stinson. The Rose and Stinson patents both fail to disclose a convenient combination mounting arrangement which can accommodate other accessories such as sights, auxiliary arrow holders or bow-fishing reels.

In U.S. Pat. No. 3,116,730 to Tingley a detachable quiver is disclosed which incorporates a spring clip for holding an extra arrow when the quiver is detached from the bow. The spring clip is located on the same arm as the detachable quiver and is semipermanently fastened to the bow. The Tingley patent fails to disclose a universal bracket to which a sight or bow-fishing reel may be attached.

Another approach to the problem of attaching accessories to an archery bow is disclosed in U.S. Pat. No. 3,844,268 to Ikeya wherein a bow body is provided with integrally molded fixtures for attaching a guide rail for a sight, an arrow rest aperture, and a stabilizer to a bow adjacent the handle. However, Ikeya fails to disclose a mounting arrangement for a quiver, an auxiliary arrow holder or a bow-fishing reel.

Another accessory mounting arrangement is disclosed in a Kwikee Kwiver cable guard to which an auxiliary arrow holder and bow-fishing reel may be attached. The Kwikee Kwiver device fails to disclose a universal mount for receiving a detachable quiver and archery sights on the same mount. Further, the mounting arrangement used by Kwikee Kwiver is a complex multi-part device.

The above problems are solved according to the present invention as summarized below.

SUMMARY OF THE INVENTION

According to the present invention, an accessory is attached to an archery bow by a support block. One or more accessories may be conveniently and interchangeably attached to the support block. The support block has an internal opening including top and bottom sides extending in the same direction as an arrow is shot from the bow. The internal opening in the support block has an inwardly facing side facing toward the bow and extending between the top and bottom sides. The inwardly facing side is located between the side of the block which is attached to the bow and the outboard side of the block. The accessory is attached to the support block by means of a tang which extends from the accessory and includes top and bottom surfaces adapted to fit within the top and bottom sides of the opening in the support block. The tang is slideably received in the opening to secure the accessory to the bow. Locking means interconnect the support block and tang for detachably securing the tang within the support block.

According to one aspect of the invention the opening includes an outwardly facing side facing away from the bow and extending between the top and bottom sides to form a tunnel that extends through the support block from the front side through to the back side of the support block. Alternatively, the outwardly facing side of the internal opening may be formed by a portion of the bow or other surface over which the support block is secured.

The accessories preferably include a shoulder where the tang extends from the accessory. The shoulder corresponds in shape to one of the sides of the support block adjacent to the internal opening to permit abutting the accessory against the support block.

An important object achieved by a preferred embodiment of the present invention is the provision of a support block in which more than one accessory can be secured by a single locking means. The accessories each include a tang which is inserted into the internal opening and locked in place by the locking means. The locking means is preferably a set screw received within a threaded opening in the support block between the top and bottom sides of the internal opening.

A detachable quiver may be conveniently incorporated on the outboard side of the support block. When a detachable quiver is used, an auxiliary arrow holder may be provided to permit the archer to take an extra shot even though the detachable quiver has been removed from the bow. The auxiliary arrow holder is preferably a separate and distinct arm extending from the support block completely independently of the detachable quiver.

Another accessory that may be attached to the support block is a detachable sight that may be provided with or without the auxiliary arrow holder or the detachable quiver.

In another embodiment of the invention, a bow-fishing reel may be attached to the support block in conjunction with or in place of the detachable sight.

The detachable quiver mount is preferably formed in two parts with the first part being a T-slot formed in the support block and the second part comprising a T-extension formed on the detachable quiver.

According to another aspect of the present invention, the retrofit auxiliary arrow holder for an archery bow may include a plate. The plate preferably includes first and second oppositely oriented planar sides with the first side being secured to the archery bow, the second side facing away from the bow, and a third side facing rearwardly and extending between the first and second sides. A quiver is provided which includes a mounting bracket for connecting the bracket to the bow which engages the second, or outboard side, of the plate. The quiver mounting bracket is connected to the bow through the plate. An auxiliary arrow support bracket is located between the quiver and the bow string of the bow. The arrow support bracket is spaced from and distinct from the plate. The arrow support bracket includes a clip for retaining a single arrow on the arrow support bracket completely independent of the detachable quiver. The arrow support bracket is connected to the plate by means of an elongated arm which is attached on one end to the third side of the plate and extends away from the plate to arrow support bracket.

The elongated arm preferably includes a tang extending therefrom having top and bottom surfaces which are received within top and bottom sides of an internal opening formed in the plate. The tang is held within the opening by means of a locking means or set screw which is oriented to bear upon the tang to assert a binding frictional force upon the tang.

According to another aspect of the present invention, an auxiliary arrow holder is provided which is molded in one piece and includes an arm, a tang extending from one end of the arm, and an arrow support bracket connected to the other end of the arm having a plurality of resilient fingers aligned on opposite sides of an axis which are axially offset from each other. The resilient fingers are adapted to grip the shaft of an arrow and retain the arrow in alignment with the axis.

A further aspect of the invention is the provision of a bow-fishing accessory which includes a reel having a thin rim for retaining a line which is attached to the bow-fishing arrow on a concave perimeter portion and a brace extending across the rim offset from the central axis of the rim. The reel is connected to an arm having a tang at a first end. The arm is connected to the brace on a second end of the arm. The rim of the bow-fishing accessory is preferably assembled to the bow to be coaxial with the arrow when the arrow is held in its operative position on the bow.

These and other features of the present invention will become apparent in view of the following detailed description of the invention in view of the attached drawings.

BRIEF DESCRIPTION OF THE DRAWINGS

FIG. 1 is an exploded perspective view showing a support block, an auxiliary arrow holder, a sight pin mounting bracket and showing fragmentarily a bow and a detachable quiver;

FIG. 2 is a side elevational view of the support block secured to the bow over the plate of a cable guard with an auxiliary arrow holder and sight pin bracket attached;

DETAILED DESCRIPTION

Figure 3:
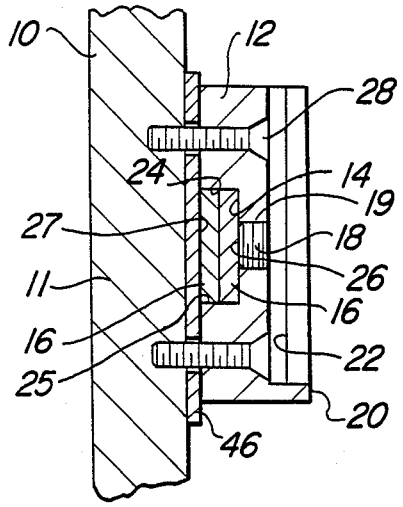
FIG. 3 is a cross sectional view taken along the line 3—3 in FIG. 2.

Referring now to the drawings, an archery bow 10 is shown in fragmentary perspective in FIG. 1. The archery bow 10 includes a bow riser 11 to which a support block 12 is secured. The support block has an internal opening 14 in which a tang 16 of one or more archery accessories 17 is received. The tang 16 is locked within the internal opening 14 by locking means. The locking means is preferably a set screw 18 which is received in threaded hole 19. The support block 12 includes an outboard surface 20 which faces away from the bow riser 11.

A detachable quiver 21 is preferably provided on the archery bow 10 according to the present invention. The detachable quiver 21 includes a two part detachable mount comprising a first part, or T-slot 22, formed in the support block. A second part, or T-projection 23, of the detachable mount is formed as part of the detachable quiver 21.

Figure 10:
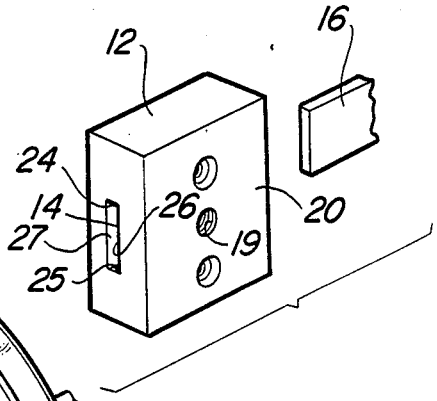
FIG. 10 is a perspective view showing an alternative embodiment of a support block and a fragmentary portion of a tang of an archery accessory.

The internal opening 14 is an important element of the present invention. The internal opening 14 extends in the same direction as the bow is adapted to project an arrow. The opening 14 includes a top side 24 and a bottom side 25 which are connected by an inwardly facing side 26. An outwardly facing side 27 may be formed by the surface to which the support block 12 is attached or it may be formed in the support block as shown in FIG. 10. Fasteners 28 such as screws are used to connect the support block 12 to the bow riser 11. The top and bottom sides 24 and 25 of the opening 14 are preferably parallel to one another and extend completely through the support block 12. Likewise, the inwardly and outwardly facing sides 26 and 27 are preferably parallel to one another. The sides 24–27 of the opening 14 could be tapered, if desired.

Another accessory 17 which may be advantageously attached to the archery bow 10 by the support block 12 is a sight 30. The sight 30 is adapted to hold sight pins 31 in a predetermined spacial relationship relative to the bow riser 11. An important feature of the present invention is that the sight pins 31, once set, do not require realignment when the sight is detached from the archery bow 10 because the internal opening extends from front to back through the support block 12 at a fixed vertical point on the bow riser 11. The sight pins 31 are preferably received in sight pin slots 32 formed in a flange 33 of the sight 30. Proper alignment of the sight 30 is further assured by the provision of a shoulder 34 at the point at which the tang 16 extends from the sight 30. The shoulder 34 is adapted to be placed in abutment with the front side of the support block 12 when the sight 30 is properly located in the support block 12. An arm 35 interconnects the flange 33 to the shoulder 34.

Referring now to FIG. 2, an arrow 36 is shown disposed in an auxiliary arrow holder 37 which is another accessory that may be attached to the archery bow 10 by means of the support block 12. The auxiliary arrow holder 37 includes an arrow clip 38. The arrow clip 38 includes a plurality of offset opposed fingers 39 which grip the arrow 36. When the arrow clip 38 is attached to the support block 12 it is held spaced from the support block by the length of an arm 40.

A shoulder 41 is preferably provided on the arm 40 at the point that the tang 16 extends from the arm 40. The auxiliary arrow holder is properly installed on the support block 12 when the shoulder 41 is in abutment with the support block 12 adjacent the internal opening 14.

The offset opposed fingers 39 of the arrow clip 38 preferably include a molded rib 43 which reinforces the fingers 39. The fingers also preferably include a curved tip 44 in which the auxiliary arrow 36 is seated. The curved tips 41 are interconnected with the body of the arrow clip 38 by distally converging base portion 45. As shown in FIG. 2, the support block 12 is connected to a cable guard plate 46. The cable guard plate 46 forms part of a cable guard frequently used with compound bows.

Referring now to FIG. 3, attachment of the support block 12 to an archery bow 10 over a cable guard plate 46 is illustrated. The opening 14 of the support block receives the tangs 16 of two accessories 17 such as a sight and a auxiliary arrow holder. The tangs are locked into position solely by means of the set screw 18 which is received in the threaded opening 19 extending inwardly from the outboard surface 20. A T-slot 22 is formed in the outboard surface 20 for receiving a detachable quiver 21. The internal opening 14 in the support block 12 includes top, bottom and inwardly facing sides 24, 25 and 26. Outwardly facing side 27 is formed by the surface of the cable guard plate 46 between the top and bottom sides. If the bow is used without a cable guard, the bow riser 11 will form the outwardly facing side 27 of the internal opening 14. The support block is connected to the bow riser 11 through the cable guard plate 46 by means of fasteners 28.

Figure 4:
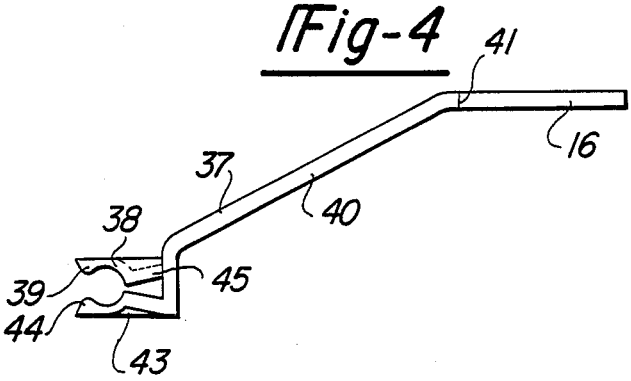
FIG. 4 is a plan view of the auxiliary arrow holder.
Figure 6:
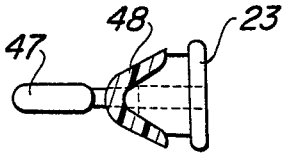
FIG. 6 is a cross-sectional view taken along the line 6—6 in FIG. 5.
Figure 7:
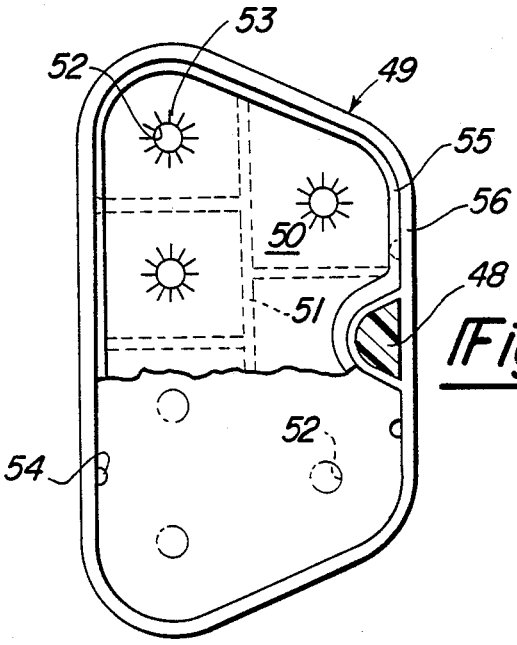
FIG. 7 is a cross-sectional view taken along the line 7—7 in FIG. 5.

Referring now to FIG. 4, the auxiliary arrow holder 37 includes a tang 16 which extends from the necked-down arm 40 at the shoulder 41. The arm 40 preferably extends rearwardly and outwardly from the bow riser to hold the auxiliary arrow in a convenient location adjacent the archers bow string gripping hand. The fingers 39 are offset from each other along the length of the arrow shaft and are disposed on opposite sides of the arrow shaft so that the curved tips 44 of the fingers 39 grip the arrow.

Figure 5:
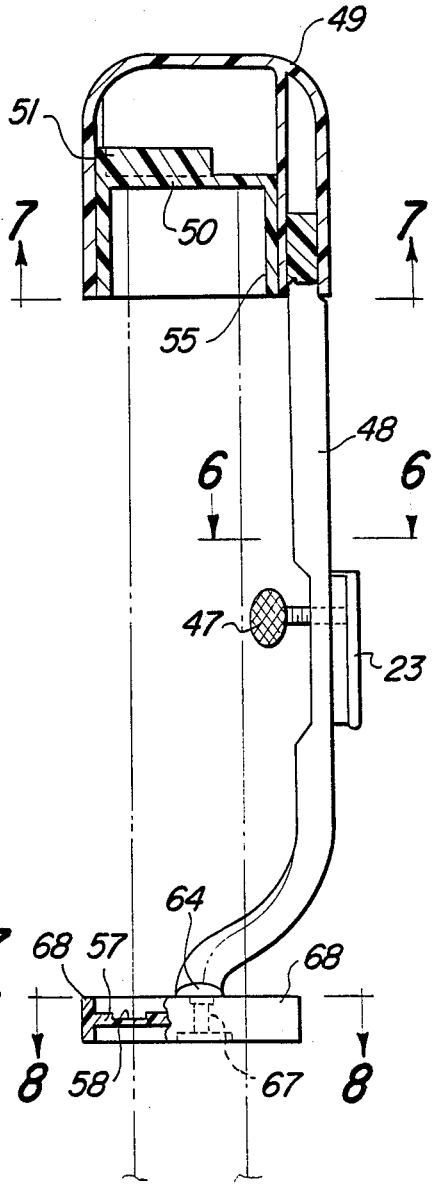
FIG. 5 is a partial cross-sectional view of a detachable quiver adapted for use with the present invention.

Referring now to FIG. 5, a detachable quiver 21 adapted to be attached to a support block 12 having a T-slot 22 is illustrated. The detachable quiver 21 includes a post 48 which interconnects the arrowhead cover 49 to the second part or T-projection 23. The T-projection 23 is adapted to be received in the T-slot 22 formed on the support block 12. The cover 49 houses a plate 50 that is preferably reinforced by ribs 51. The plate 50 includes arrowhead receiving holes 52 having blade slots 53 which receive the blades of a broad head type arrowhead. The plate 50 is located within the cover 49 by seats 54 which are spaced about the perimeter of the cover 49. The cover 49 is preferably formed in two pieces comprising inner cup 55 that is received in an outer cup 56. The inner cup 55 includes the plate 50, reinforcement ribs 51 and arrow head receiving holes 52. The outer cup 56 includes the seats 54 against which the inner cup 55 is placed.

Figure 8:
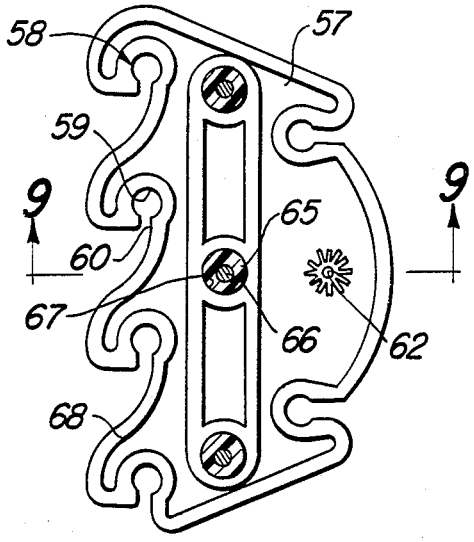
FIG. 8 is a cross-sectional view taken along the line 8—8 in FIG. 5.
Figure 9:
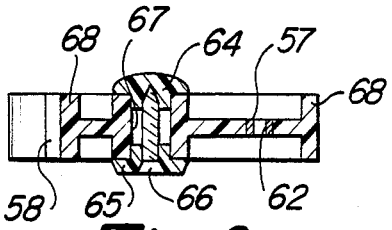
FIG. 9 is a cross-sectional view taken along the line 9—9 in FIG. 8.

Referring now to FIGS. 5, 8 and 9 a rack 57 for retaining arrows in the quiver 21 is illustrated in detail. The rack 57 includes a plurality of notches 58 spaced around its perimeter in which arrows 36 are inserted. The notches 58 include a semicircular portion 59 and a neck 60 leading from the outer edge of the rack 57 to the semicircular portion 59. The rack 57 preferably includes an arrowhead tightener 62 in a central portion which is used to tighten broad head type arrowheads.

The rack 57 is connected to a flaired end of the post 48 which extends below the two part detachable quiver mount. The rack 57 is connected to the flaired end 64 by bushings 65 which are held against the rack by fasteners 66 that are received through holes 67 in the rack 57. The rack 57 is preferably reinforced by an edge rib 68 extending about its periphery and around each of the notches 58.

Referring now to FIG. 10, an alternative embodiment of the support block 12 of the present invention is shown which does not include a T-slot for receiving a detachable quiver 21. The support block 12 of FIG. 10 includes an internal opening 14 having sides which are completely defined by the support block 12. The internal opening 14 is sized to accept only one tang 16 but could be modified to accept more than one tang 16. The internal opening 14 extends from the front of the support block 12 to the back of the support block and includes top, bottom, inwardly facing and outwardly facing sides 24-27. The embodiment of FIG. 10 shows an internal opening 14 having room for only one tang for attaching only a single accessory such as a bow-fishing reel or a sight to the bow.

Figure 11:
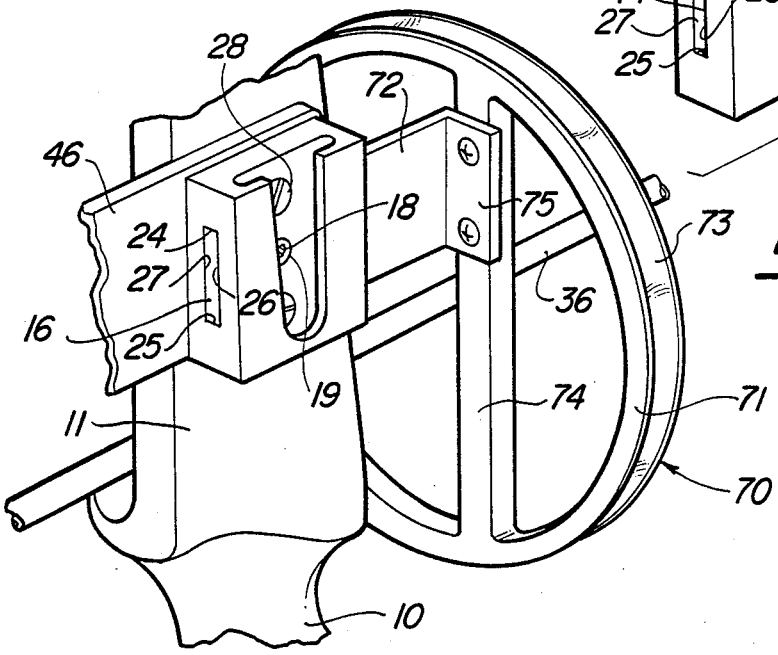
FIG. 11 is a fragmentary perspective view of a bow having a bow-fishing reel secured to a support block which is also adapted to receive a detachable quiver.

Referring now to FIG. 11, a bow-fishing accessory 70 is attached to a archery bow 10 with an arrow 36 in position for shooting. The bow-fishing accessory 70 includes a reel 71 which is connected to the support block 12 by means of an arm 72 having a tang 16. The arm 72 is connected to a rim 73 of the reel 71 by means of an offset cross member 74. The offset cross member 74 forms a chord extending through the rim 73. The arm 72 includes a flange 75 that is fastened to the offset cross member 74. The rim 73 is preferably relatively thin and substantially concentric with the arrow 36 as shown in FIG. 11. This provides a unobstructed view of the primary target area which is defined by the inner diameter of the rim 73. A line is wound about the rim 73 and connected to the arrow 36 to permit retrieval of the arrow after shooting. The concentricity of the arrow relative to the rim 73 minimizes the effect of the line upon the flight of the arrow because the line unwinds about the rim in a balanced manner.

It should be understood that the above embodiments of the present invention have been described as specific preferred embodiments and that many alternatives, modifications and variations will be apparent to one skilled in the art based upon the above description. Accordingly; such alternatives, modifications, and variations are intended to be embraced within the scope of the following claims.

What is claimed is:

1. In combination, an archery bow and an accessory attached to the bow comprising:

a support block having an internal opening including top and bottom sides extending through the block in one direction corresponding to the direction an arrow is shot, said internal opening having an inwardly facing side facing toward the bow and extending between said top and bottom sides of the block, said inwardly facing side being intermediate an inboard side of the block, which is attached to the bow and an outboard side of the block which faces away from the bow;

fastener means for securing said block to said bow;

an accessory;

tang means extending from said accessory and having top and bottom surfaces adapted to fit within said top and bottom sides of the opening of the support block, said tang being slideably received in said opening for securing said accessory to said bow; and locking means interconnecting said support block and said tang for detachably securing said tang within said support block.

2. The combination of claim 1, wherein the opening includes an outwardly facing side facing away from the bow and extending between the top and bottom sides, said outwardly facing side forming a tunnel with the top, bottom and inwardly facing sides which extend through the support block from the front through to the back of the support block.

3. The combination of claim 2, wherein the outwardly facing side is formed by a surface over which said support block is secured.

4. The combination of claim 1, wherein a shoulder means is formed on said accessory where the tang extends from the accessory, said shoulder corresponding in shape to one exterior side of said support block adjacent the internal opening thereby allowing said shoulder to abut said exterior side of said support block.

5. The combination of claim 1, wherein two accessories are provided and each of said accessories include one of said tang means with one of said tang means being inserted into the support block through a front exterior side and the other of said tang means being inserted into the support block through a back exterior side.

6. The combination of claim 1, wherein said locking means is a set screw threadably received in a bore having an axis perpendicular to the tang, said set screw engaging said tang between said top and bottom surfaces of the tang to exert a binding frictional force upon said tang.

7. The combination of claim 1, further including a quiver having a detachable mounting bracket which is secured to the outboard side of the support block, and said accessory is a holder for an auxiliary arrow retained spaced from said bow by the length of an arm extending from said bow independently of said quiver.

8. The combination of claim 7, wherein said tang extends from a front end of said arm, said arm having a shoulder at the point said tang extends from the arm, an arrow support bracket having a plurality of resilient fingers aligned on opposite sides of an axis and offset axially from each other, wherein said fingers are adapted to grip the shaft of an arrow and retain the arrow in alignment with the axis.

9. The combination of claim 7, wherein an archery sight is a second accessory having a tang which is received through a front exterior side of the support block and said tang means extending from said holder for an auxiliary arrow, said tang means being received through a back exterior side of the support block.

10. The combination of claim 1, wherein said accessory is a reel for receiving an elongated filament attached to an arrow for use in bow-fishing.

11. The combination of claim 10, wherein said reel includes a thin rim with a concave perimeter, a brace forming a chord within the rim which is offset from the central axis of the rim, an arm having a tang at the first end and being attached to the brace on a second end, said rim being coaxial with the arrow when said arrow is in position to be shot from the bow.

12. The combination of claim 1, wherein a first part of a two part detachable mount is formed by a portion of said outboard side of the support block, and a second part of the two part detachable mount is attached to an arrow quiver.

13. The combination of claim 12, wherein said first part is an T-slot having an open upper end and said second part is a T-extension adapted to be fit into said T-slot.

14. A retrofit auxiliary arrow holder apparatus for an archery bow having a bow string comprising:

a plate having first and second oppositely oriented planar sides and a third side facing the bow string and extending between said first and second sides;

said first side being adapted to be secured to said archery bow;

a quiver having a mounting bracket and means for connecting said bracket to said bow;

said second side being adapted to engage said mounting bracket wherein said mounting bracket is connected to said bow through said plate;

an arrow support bracket disposed between the quiver and the bow string, said arrow support bracket being spaced and distinct from said plate;

third means disposed on said arrow support bracket for detachably retaining a single arrow independently of said quiver; and an elongated arm attached on one end contiguous with the third side of said plate and extending away from said plate to the arrow support bracket, said elongate arm along its length being distinct from said plate, whereby an extra arrow may be retained on the bow entirely independent of the quiver and the quiver mounting bracket.

15. The retrofit auxiliary arrow holder apparatus of claim 14, wherein said elongated arm includes a tang means extending therefrom and having top and bottom surfaces, said plate having an opening formed through said third side, said tang being slideable into said opening.

16. The retrofit auxiliary arrow holder of claim 15, further including locking means for selectively locking said tang means within said opening.

17. The retrofit auxiliary arrow holder of claim 16, wherein said locking means is a set screw threadably received in a bore having an axis perpendicular to the tang intermediate the top and bottom surfaces of the tang, said set screw engaging said tang between said top and bottom surfaces for exerting a binding frictional force upon said tang.

18. An auxiliary arrow holder comprising an arm, a tang extending from a front end of the arm, said arm having a shoulder at the point said tang extends from the arm, an arrow support bracket having at least one pair of resilient fingers on opposite sides of an axis, said fingers being offset from one another in staggered relation along said axis, wherein said fingers are adapted to grip the shaft of an arrow and retain the arrow in alignment with the axis.

19. The auxiliary arrow holder of claim 18, wherein said arm, tang, shoulder, bracket and fingers are molded in one piece.

* * * * *